US008089410B2

(12) United States Patent
Shimizu

(10) Patent No.: US 8,089,410 B2
(45) Date of Patent: Jan. 3, 2012

(54) DUAL-BAND ANTENNA

(75) Inventor: Hiroshi Shimizu, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 133 days.

(21) Appl. No.: 12/452,149

(22) PCT Filed: Jan. 30, 2009

(86) PCT No.: PCT/JP2009/051536

§ 371 (c)(1),
(2), (4) Date: Dec. 17, 2009

(87) PCT Pub. No.: WO2009/142031

PCT Pub. Date: Nov. 26, 2009

(65) Prior Publication Data

US 2010/0103050 A1 Apr. 29, 2010

(30) Foreign Application Priority Data

May 22, 2008 (JP) ..... 2008-133922

(51) Int. Cl.
*H01Q 1/38* (2006.01)

(52) U.S. Cl. ..... 343/700 MS

(58) Field of Classification Search ..... 343/700 MS, 343/795

See application file for complete search history.

(56) References Cited

U.S. PATENT DOCUMENTS

| | | | | |
|---|---|---|---|---|
| 6,377,227 | B1 | 4/2002 | Zhu et al. | |
| 6,859,176 | B2 | 2/2005 | Choi | |
| 2006/0071858 | A1 | 4/2006 | Suh | |
| 2006/0158383 | A1 | 7/2006 | Kwon et al. | |
| 2007/0229361 | A1 * | 10/2007 | Yanagi et al. | 343/700 MS |

FOREIGN PATENT DOCUMENTS

| | | |
|---|---|---|
| JP | A 2001-267831 | 9/2001 |
| JP | A 2004-282329 | 10/2004 |

OTHER PUBLICATIONS

International Search Report issued in corresponding International Application No. PCT/JP2009/051536, mailed May 12, 2009.

* cited by examiner

*Primary Examiner* — Douglas W Owens
*Assistant Examiner* — Dieu H Duong
(74) *Attorney, Agent, or Firm* — Oliff & Berridge, PLC

(57) ABSTRACT

The present invention provides a dual-band antenna that can be operated at two frequencies without providing the choke coil. A first element operated in a high-frequency-side band is formed in a surface of a print board using a print pattern. A second element operated in a low-frequency-side band is formed in an upper portion of a rear surface of the print board so as not to overlap the first element. A power is fed to the first element from a power feeding point located at a lower end of the print board, and the power is fed to the second element through a throughhole made in a middle of the first element. The power is fed to the second element from the throughhole through a long and thin power feeding line, and the power feeding line exhibits a high impedance to a high frequency. A slit is formed in the first element corresponding to the power feeding line.

4 Claims, 6 Drawing Sheets

Polarization : Vertical
Earth Condition : $\phi$1m
Elevation : $\theta$ =0[deg]

Directional Gain Elevation Angle 0deg

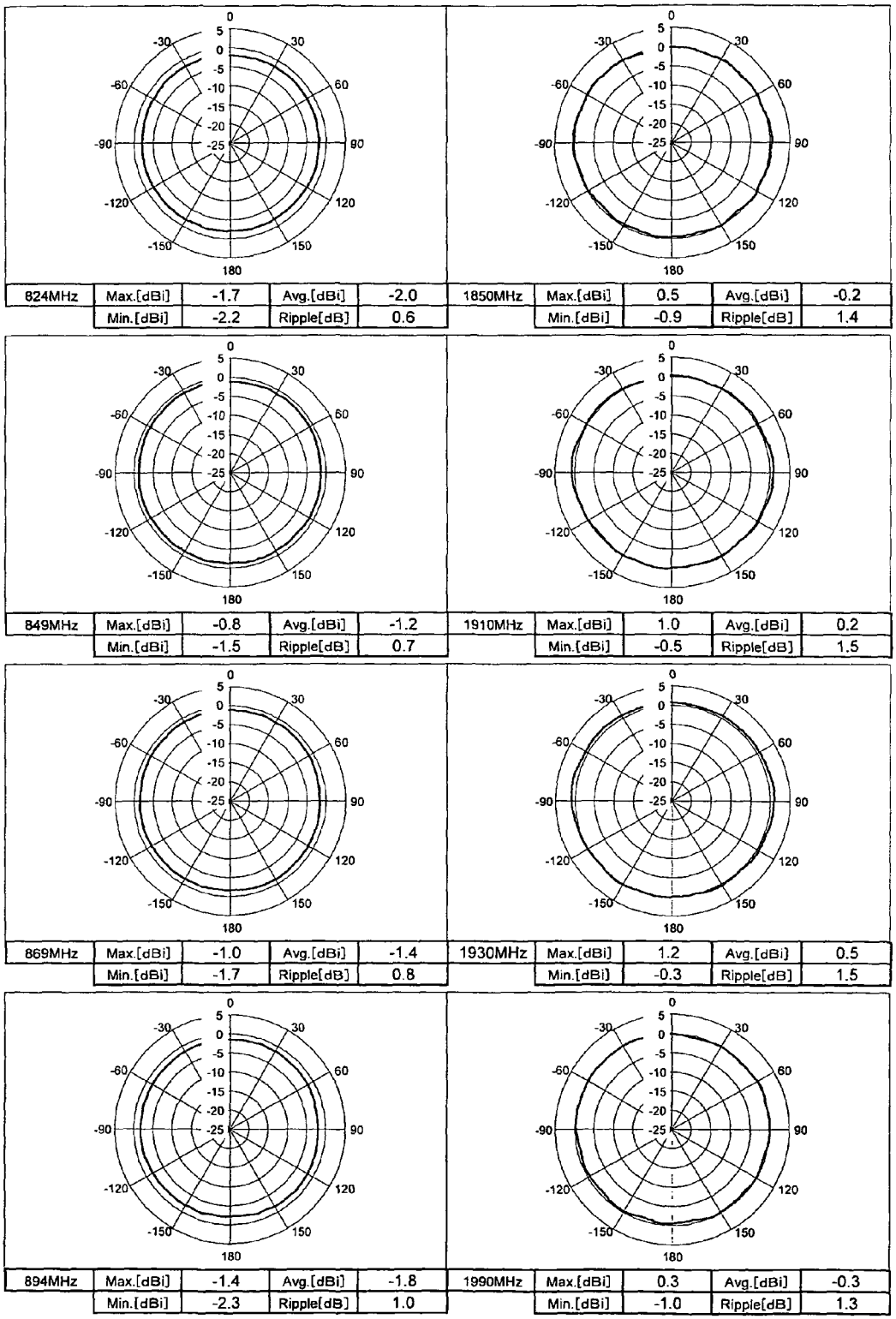

| | | | | | | | | |
|---|---|---|---|---|---|---|---|---|
| 824MHz | Max.[dBi] | -1.7 | Avg.[dBi] | -2.0 | 1850MHz | Max.[dBi] | 0.5 | Avg.[dBi] | -0.2 |
| | Min.[dBi] | -2.2 | Ripple[dB] | 0.6 | | Min.[dBi] | -0.9 | Ripple[dB] | 1.4 |
| 849MHz | Max.[dBi] | -0.8 | Avg.[dBi] | -1.2 | 1910MHz | Max.[dBi] | 1.0 | Avg.[dBi] | 0.2 |
| | Min.[dBi] | -1.5 | Ripple[dB] | 0.7 | | Min.[dBi] | -0.5 | Ripple[dB] | 1.5 |
| 869MHz | Max.[dBi] | -1.0 | Avg.[dBi] | -1.4 | 1930MHz | Max.[dBi] | 1.2 | Avg.[dBi] | 0.5 |
| | Min.[dBi] | -1.7 | Ripple[dB] | 0.8 | | Min.[dBi] | -0.3 | Ripple[dB] | 1.5 |
| 894MHz | Max.[dBi] | -1.4 | Avg.[dBi] | -1.8 | 1990MHz | Max.[dBi] | 0.3 | Avg.[dBi] | -0.3 |
| | Min.[dBi] | -2.3 | Ripple[dB] | 1.0 | | Min.[dBi] | -1.0 | Ripple[dB] | 1.3 |

Fig.5

Polarization : Vertical
Earth Condition : $\phi$1m
Elevation : $\theta$ =10[deg]

Directional Gain Elevation Angle 10deg

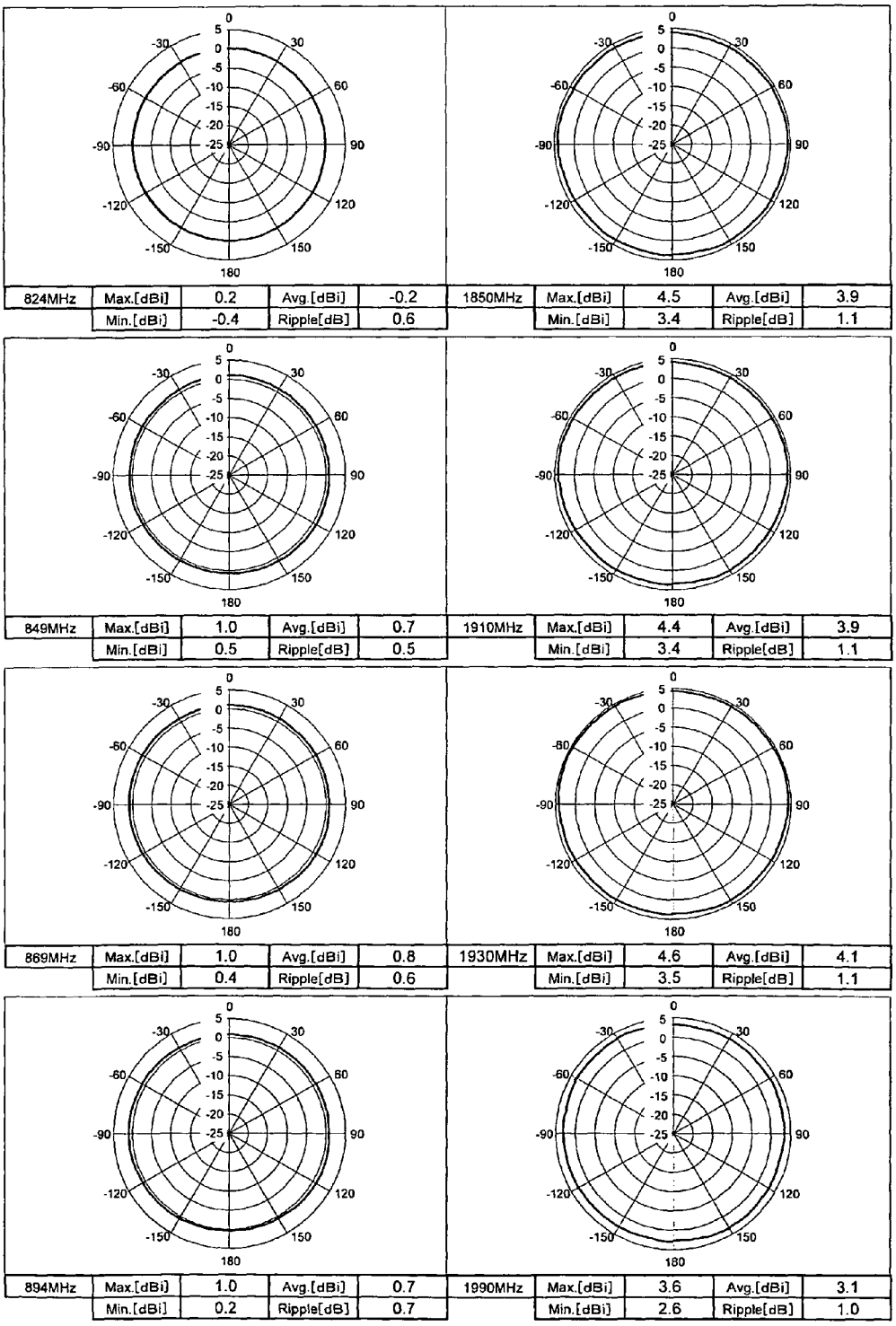

| | | | | | | | | | |
|---|---|---|---|---|---|---|---|---|---|
| 824MHz | Max.[dBi] | 0.2 | Avg.[dBi] | -0.2 | 1850MHz | Max.[dBi] | 4.5 | Avg.[dBi] | 3.9 |
| | Min.[dBi] | -0.4 | Ripple[dB] | 0.6 | | Min.[dBi] | 3.4 | Ripple[dB] | 1.1 |
| 849MHz | Max.[dBi] | 1.0 | Avg.[dBi] | 0.7 | 1910MHz | Max.[dBi] | 4.4 | Avg.[dBi] | 3.9 |
| | Min.[dBi] | 0.5 | Ripple[dB] | 0.5 | | Min.[dBi] | 3.4 | Ripple[dB] | 1.1 |
| 869MHz | Max.[dBi] | 1.0 | Avg.[dBi] | 0.8 | 1930MHz | Max.[dBi] | 4.6 | Avg.[dBi] | 4.1 |
| | Min.[dBi] | 0.4 | Ripple[dB] | 0.6 | | Min.[dBi] | 3.5 | Ripple[dB] | 1.1 |
| 894MHz | Max.[dBi] | 1.0 | Avg.[dBi] | 0.7 | 1990MHz | Max.[dBi] | 3.6 | Avg.[dBi] | 3.1 |
| | Min.[dBi] | 0.2 | Ripple[dB] | 0.7 | | Min.[dBi] | 2.6 | Ripple[dB] | 1.0 |

Fig.6

Directional Gain Elevation Angle 20deg

Polarization : Vertical
Earth Condition : $\phi$1m
Elevation : $\theta$ =20[deg]

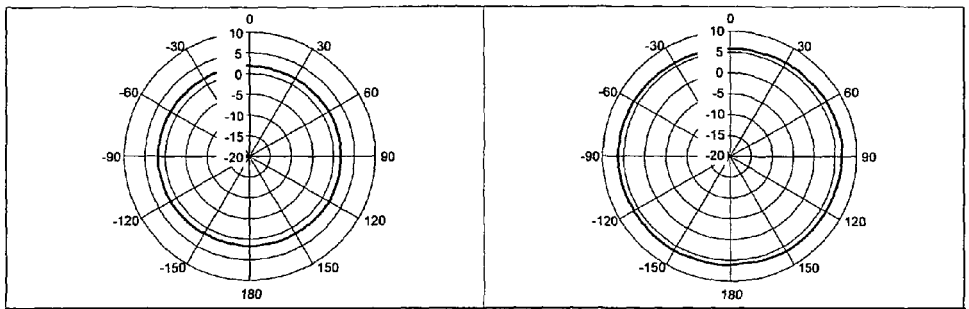

| | | | | | | | | |
|---|---|---|---|---|---|---|---|---|
| 824MHz | Max.[dBi] | 1.8 | Avg.[dBi] | 1.7 | 1850MHz | Max.[dBi] | 6.6 | Avg.[dBi] | 6.1 |
| | Min.[dBi] | 1.4 | Ripple[dB] | 0.4 | | Min.[dBi] | 5.8 | Ripple[dB] | 0.8 |

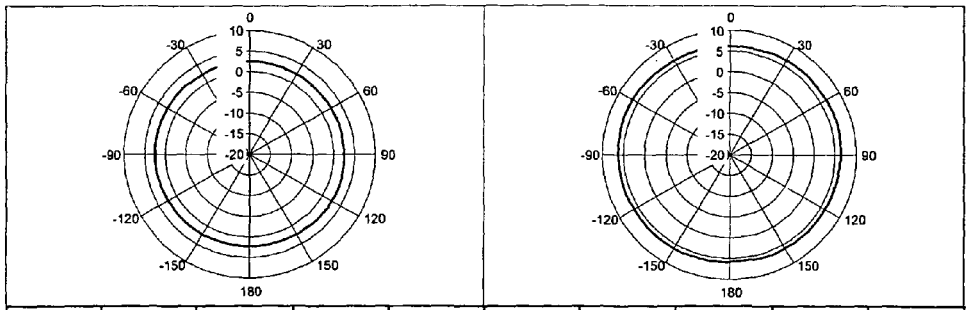

| | | | | | | | | |
|---|---|---|---|---|---|---|---|---|
| 849MHz | Max.[dBi] | 2.6 | Avg.[dBi] | 2.4 | 1910MHz | Max.[dBi] | 6.6 | Avg.[dBi] | 6.2 |
| | Min.[dBi] | 2.2 | Ripple[dB] | 0.5 | | Min.[dBi] | 5.7 | Ripple[dB] | 0.9 |

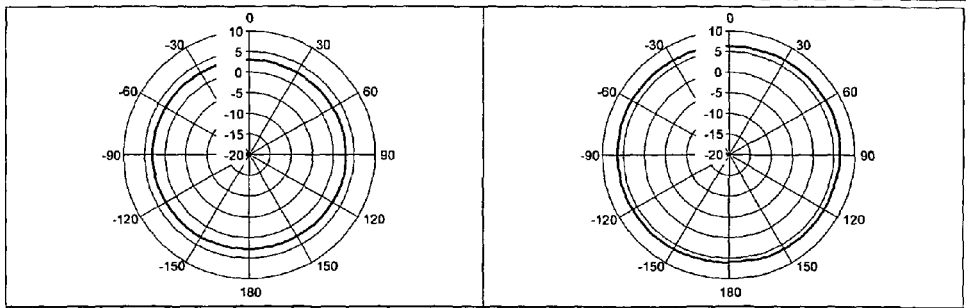

| | | | | | | | | |
|---|---|---|---|---|---|---|---|---|
| 869MHz | Max.[dBi] | 3.1 | Avg.[dBi] | 2.9 | 1930MHz | Max.[dBi] | 6.7 | Avg.[dBi] | 6.3 |
| | Min.[dBi] | 2.7 | Ripple[dB] | 0.4 | | Min.[dBi] | 5.7 | Ripple[dB] | 1.0 |

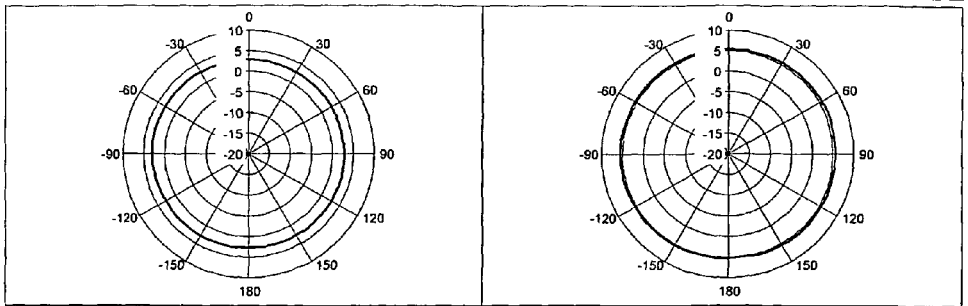

| | | | | | | | | |
|---|---|---|---|---|---|---|---|---|
| 894MHz | Max.[dBi] | 3.0 | Avg.[dBi] | 2.8 | 1990MHz | Max.[dBi] | 5.7 | Avg.[dBi] | 5.4 |
| | Min.[dBi] | 2.6 | Ripple[dB] | 0.4 | | Min.[dBi] | 5.0 | Ripple[dB] | 0.7 |

Fig.7

Polarization : Vertical
Earth Condition : $\phi$1m
Elevation : $\theta$ =30[deg]

Directional Gain Elevation Angle 30deg

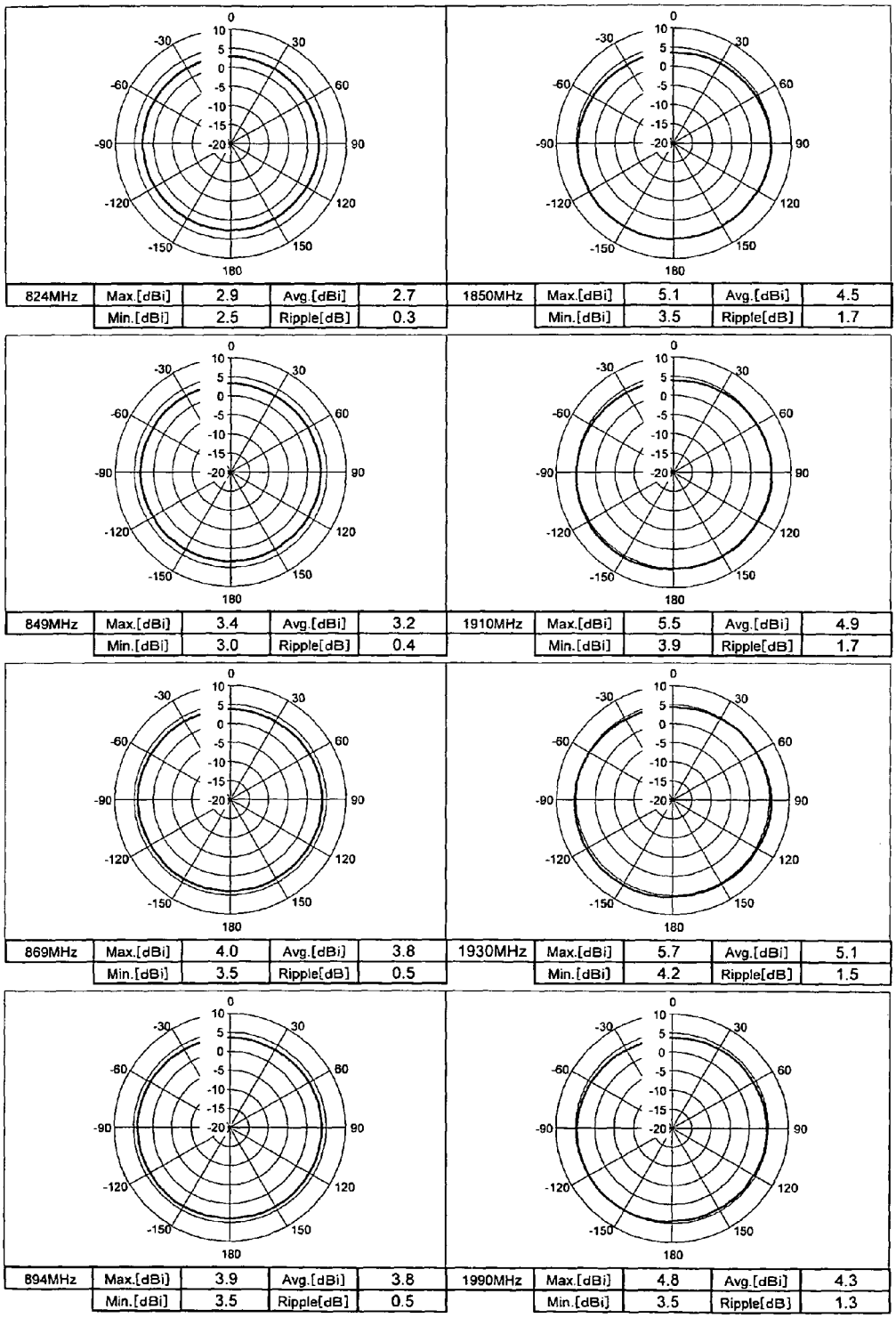

| | | | | | | | | | |
|---|---|---|---|---|---|---|---|---|---|
| 824MHz | Max.[dBi] | 2.9 | Avg.[dBi] | 2.7 | 1850MHz | Max.[dBi] | 5.1 | Avg.[dBi] | 4.5 |
| | Min.[dBi] | 2.5 | Ripple[dB] | 0.3 | | Min.[dBi] | 3.5 | Ripple[dB] | 1.7 |
| 849MHz | Max.[dBi] | 3.4 | Avg.[dBi] | 3.2 | 1910MHz | Max.[dBi] | 5.5 | Avg.[dBi] | 4.9 |
| | Min.[dBi] | 3.0 | Ripple[dB] | 0.4 | | Min.[dBi] | 3.9 | Ripple[dB] | 1.7 |
| 869MHz | Max.[dBi] | 4.0 | Avg.[dBi] | 3.8 | 1930MHz | Max.[dBi] | 5.7 | Avg.[dBi] | 5.1 |
| | Min.[dBi] | 3.5 | Ripple[dB] | 0.5 | | Min.[dBi] | 4.2 | Ripple[dB] | 1.5 |
| 894MHz | Max.[dBi] | 3.9 | Avg.[dBi] | 3.8 | 1990MHz | Max.[dBi] | 4.8 | Avg.[dBi] | 4.3 |
| | Min.[dBi] | 3.5 | Ripple[dB] | 0.5 | | Min.[dBi] | 3.5 | Ripple[dB] | 1.3 |

Fig.8

DUAL-BAND ANTENNA

TECHNICAL FIELD

The present invention relates to a compact dual-band antenna that is operated at two frequencies.

BACKGROUND ART

In an antenna used in in-vehicle radio communication, from the viewpoint of an operating principle of the antenna, there is concern that electromagnetic radiation negatively affects a passenger in a vehicle cabin during transmission. Therefore, frequently the antenna is placed outside the vehicle such as a roof panel. However, because there is a limitation to an antenna height of the antenna projected toward the outside of the vehicle due to regulations, there is a demand for the low-profile and compact antenna.

Conventionally, in cases where the antenna that performs reception and transmission in the desired two different frequency bands is required, two resonances is obtained by providing a choke coil between antenna elements, two outputs are obtained at two frequencies using the two independent antennas, or an output is obtained by combining the two outputs at the two frequencies.

DISCLOSURE OF THE INVENTION

Problem that the Invention is Intended to Solve

In the conventional dual-band antenna, the choke coil is required in the case of the one antenna. However, when the choke coil is used, unfortunately a low-frequency-side resonant band is narrowed by influence of the choke coil.

An object of the invention is to provide a dual-band antenna that can be operated in two different frequency bands without providing the choke coil.

Means for Solving the Problem

To achieve the above object, a dual-band antenna according to the present invention includes a first element that is formed into a planar shape in one of surfaces of an insulating board; a second element that is formed in the other surface of the board so as not to overlap the first element; power feeding means for feeding power to the lower end of the first element; and a throughhole that is made in an end portion of a power feeding line and connected to a middle of the first element in one of surfaces of the board, the power feeding line being led out from the second element, wherein a slit is formed in a region of the first element, the region of the first element corresponding to the power feeding line.

Effect of the Invention

In the dual-band antenna in accordance with the invention, the first element is operated on the high frequency side in the two different frequency bands, the second element is operated on the low frequency side, and the power feeding line through which the power is fed to the second element acts as the inductance. Therefore, the choke coil can be eliminated. The first element and the second element are formed by the print patterns, so that the first element and the second element can be matched by the shapes of the print patterns.

BRIEF DESCRIPTION OF DRAWINGS

FIG. 5 is a view illustrating directivity characteristics in a horizontal plane of each frequency in an AMPS band and a PCS band when the dual-band antenna according to the invention has an elevation angle of 0°.

FIG. 6 is a view illustrating directivity characteristics in the horizontal plane of each frequency in the AMPS band and PCS band when the dual-band antenna according to the invention has the elevation angle of 10°.

FIG. 7 is a view illustrating directivity characteristics in the horizontal plane of each frequency in the AMPS band and PCS band when the dual-band antenna according to the invention has the elevation angle of 20°.

FIG. 8 is a view illustrating directivity characteristics in the horizontal plane of each frequency in the AMPS band and PCS band when the dual-band antenna according to the invention has the elevation angle of 30°.

EXPLANATION OF THE REFERENCE SYMBOLS

Figure 1:
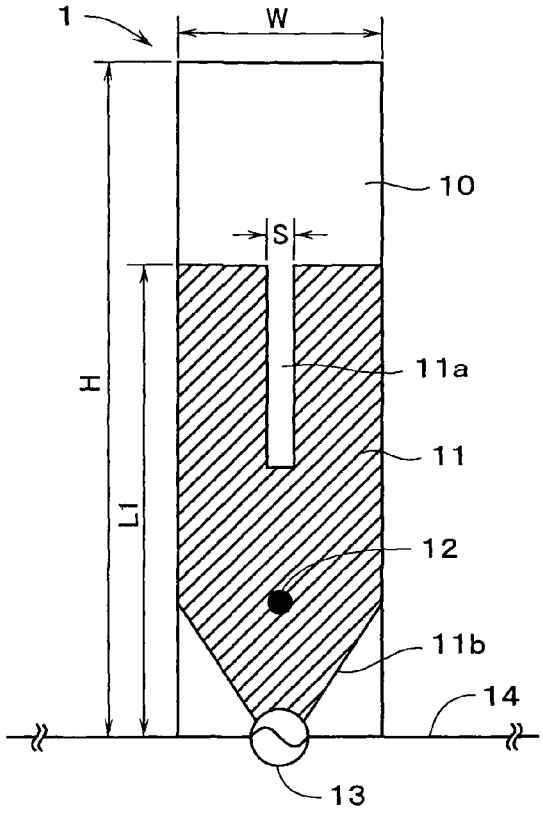
FIG. 1 is a front view illustrating a configuration of a dual-band antenna according to an embodiment of the invention.

1: dual-band antenna
10: print board
11: first element
11*a*: slit
11*b*: tapered portion
12: throughhole
13: power feeding point
14: gland
21: second element
21*a*: power feeding line

BEST MODE FOR CARRYING OUT THE INVENTION

Figure 2:
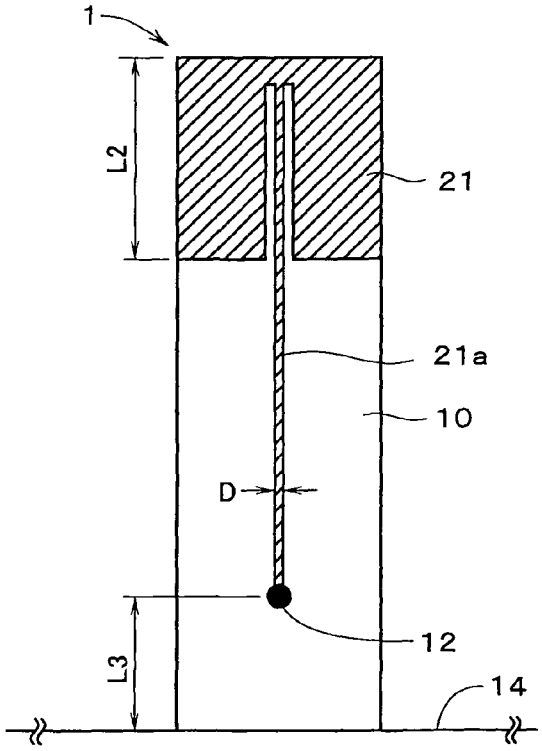
FIG. 2 is a rear view illustrating the configuration of the dual-band antenna according to the embodiment of the invention.

FIGS. 1 and 2 illustrate a configuration of a dual-band antenna 1 according to an embodiment of the invention, which is operated at two different frequency bands. FIG. 1 is a front view illustrating the configuration of the dual-band antenna 1, and FIG. 2 is a rear view illustrating the configuration of the dual-band antenna 1.

As illustrated in FIGS. 1 and 2, the dual-band antenna 1 includes a first element 11 and a second element 21. The first element 11 is formed as a print pattern in a surface of an insulating print board 10 such as a glass epoxy board, and the second element 21 is formed as the print pattern in a rear surface of the insulating print board 10. The print board 10 is formed into a long and thin rectangle having a height H and a width W, and the print board 10 is substantially vertically provided on a planar gland 14. The first element 11 is formed as the planar print pattern substantially having the width W and a length L1 from a lower end of the surface of the print board 10. A tapered portion 11*b* is formed in a lower portion of the first element 11, and a width of the tapered portion 11*b* is gradually narrowed toward the lower end to adjust an impedance. A slit 11*a* having a width S is formed downward from a substantial center of an upper edge of the first element 11. An electric power is fed from the lower end to the first element 11, and a power feeding point 13 is provided at the lower end of the first element 11. A throughhole 12 is made in the substantial center of the print board 10 so as to be electrically connected to the rear surface. The throughhole 12 is located at a height L3 from the power feeding point 13 that is of the lower end of the print board 10.

The second element 21 is formed as the planar print pattern having the width W and a length L2 from an upper end of the rear surface of the print board 10, and both sides of the second element 21 are folded downward. The second element 21 is formed in an upper portion of the print board 10 such that the second element 21 does not overlap the first element 11 formed in the surface of the print board 10. A narrow power feeding line 21*a* having a width D is drawn from the substantial center of the second element 21, and regions on both the folded sides of the second element 21 act as top loading. The power feeding line 21*a* acts also as the antenna, the power feeding line 21*a* is substantially perpendicularly formed from the lower end of the print board 10 to the position of the height L3, and the lower end of the power feeding line 21*a* is electrically connected to the throughhole 12. Because the power feeding line 21*a* is formed long and thin, the impedance of the power feeding line 21*a* is increased to a signal component on a lower frequency side of the two frequencies by an inductance component generated in the power feeding line 21*a*, whereby the low-frequency-side signal component is hardly transmitted on the power feeding line 21*a*. Thus, the power of the low-frequency-side signal component transmitted at the power feeding line 21*a* from the power feeding point 13 through the first element 11 and throughhole 12 is fed to the second element 21 because the power feeding line 21*a* acts as an equivalent choke coil. A low-frequency-side receiving signal of the second element 21 is combined with a high-frequency-side receiving signal of the first element 11 through the power feeding line 21*a* and throughhole 12 and supplied from the power feeding point 13. The width S of the slit 11*a* in the first element 11 is wider than the width D of the power feeding line 21*a*, the power feeding line 21*a* is located in the slit 11*a*, and the slit 11*a* prevents the electric connection between the first element 11 and the power feeding line 21*a* as much as possible.

The dual-band antenna 1 can be operated at two different frequency bands including an AMPS (Advanced Mobile Phone Service) band of 824 to 894 MHz and a PCS (Personal Communication Services) band of 1850 to 1990 MHz or at two different frequency bands including a GSM (Global System for Mobile Communications) 900 band of 880 to 960 MHz and a GSM 1800 band of 1710 to 1880 MHz. At this point, an example of dimensions of the dual-band antenna 1 will be described below. The print board 10 has the width W of about 15 mm, the height H of about 50 mm, a thickness of about 1.6 mm, and a relative permittivity $\epsilon r$ of about 4.6. In the first element 11 that is operated on the high frequency side (PCS/GMS 1800) in the two frequencies, the length L1 is set to about 34.5 mm that is expressed by about $0.21\lambda_1$ when the 1850-MHz wavelength is set to $\lambda_1$, and the slit 11*a* has the width S of about 2 mm. In the second element 21 that is operated on the low frequency side (AMPS/GMS 900) in the two frequencies, the length L2 is set to about 15 mm that is expressed by about $0.04\lambda_2$ when the 824-MHz wavelength is set to $\lambda_2$, and the height L3 of the throughhole 12 is set to about 10 mm that is expressed by about $0.06\lambda_1$ or about $0.03\lambda_2$.

Figure 3:
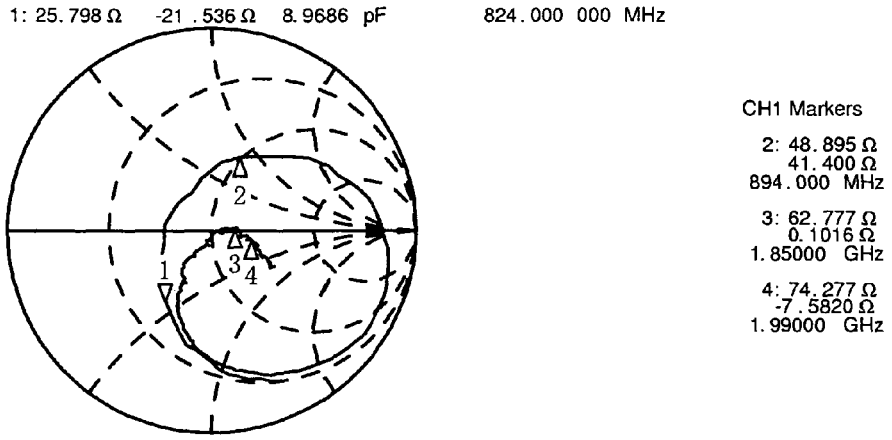
FIG. 3 is a Smith chart illustrating frequency characteristics of an impedance of the dual-band antenna according to the invention.

FIG. 3 is a Smith chart illustrating frequency characteristics of the impedance of the dual-band antenna 1 having the above-described dimensions. Referring to FIG. 3, a resistance becomes about 25.8Ω and a reactance becomes about −21.5Ω at the low-frequency-side frequency of 824 MHz, and the resistance becomes about 48.9Ω and the reactance becomes about 41.4Ω at the frequency of 894 MHz. The resistance becomes about 62.8Ω and a reactance becomes about 0.1Ω at the high-frequency-side frequency of 1850 MHz, and the resistance becomes about 74.2Ω and the reactance becomes about −7.6Ω at the frequency of 1990 MHz. Thus, the better impedance characteristics are exerted on the high frequency side.

Figure 4:
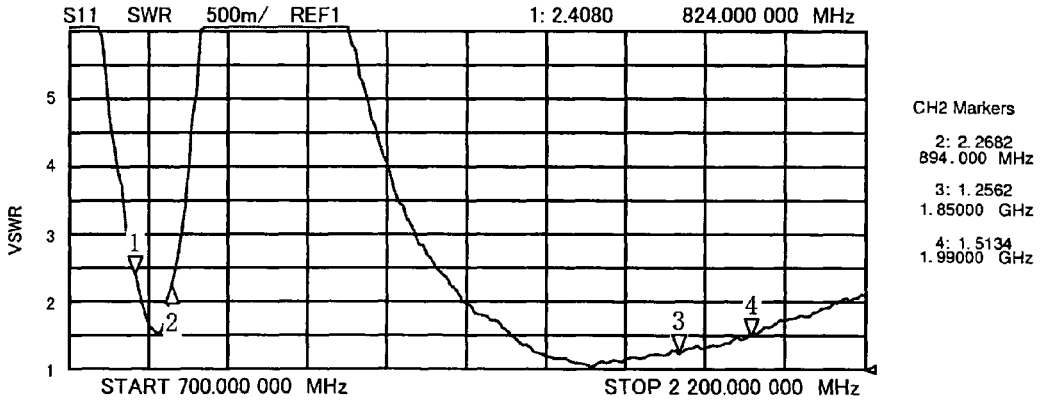
FIG. 4 is a view illustrating frequency characteristics of VSWR of the dual-band antenna according to the invention.

FIG. 4 illustrates frequency characteristics of a Voltage Standing Wave ratio (VSWR) of the dual-band antenna 1 having the above-described dimensions. Referring to FIG. 4, VSWR of about 2.41 is obtained at low-frequency-side frequency of 824 MHz, VSWR of about 2.27 is obtained at the frequency of 894 MHz, and the best VSWR of about 1.5 is obtained in the low-frequency-side frequency band of 824 to 894 MHz. VSWR of about 1.26 is obtained at the high-frequency-side frequency of 1850 MHz, VSWR of about 1.51 is obtained at the frequency of 1990 MHz, and the best VSWR of 1.26 is obtained in the high-frequency-side frequency band of 1850 to 1990 MHz. Thus, the better VSWR characteristics are exerted on the high frequency side. Generally, it is necessary that VSWR be equal to or lower than about 2.5. In the example of FIG. 4, the maximum VSWR becomes about 2.4 (840 MHz) in the AMPS band, and the maximum VSWR becomes about 1.5 (1990 MHz) in the PCS band. Therefore, the good VSWR characteristics are obtained in the two frequencies. Alternatively, the better VSWR may be obtained when a matching circuit is added to feed the power to the power feeding point 13.

FIGS. 5 to 8 illustrate directivity characteristics in a horizontal plane of each frequency of the dual-band antenna 1 according to the invention. At this point, the dimensions of the dual-band antenna 1 are similar to those described above, the dual-band antenna 1 is vertically provided in the substantial center of the circular gland 14 having a diameter of about 1 m, and a vertically-polarized wave is used as a polarized wave.

FIG. 5 illustrates directivity characteristics in the horizontal plane of each frequency in the AMPS band and PCS band when the dual-band antenna 1 according to the invention has an elevation angle of 0°. Referring to FIG. 5, in a lower limit frequency of 824 MHz of a transmitting band in the AMPS band, a maximum gain is about −1.7 dBi, a minimum gain is about −2.2 dBi, an average gain is about −2.0 dBi, and a ripple is about 0.6 dB. Therefore, the substantially omnidirectional, good directivity characteristics are obtained. In an upper limit frequency of 849 MHz of the transmitting band in the AMPS band, the maximum gain is about −0.8 dBi, the minimum gain is about −1.5 dBi, the average gain is about −1.2 dBi, and the ripple is about 0.7 dB. Therefore, the substantially omnidirectional, good directivity characteristics are obtained, and the gain is slightly improved. In a lower limit frequency of 869 MHz of a receiving band in the AMPS band, the maximum gain is about −1.0 dBi, the minimum gain is about −1.7 dBi, the average gain is about −1.4 dBi, and the ripple is about 0.8 dB. Therefore, the substantially omnidirectional, good directivity characteristics are obtained. In an upper limit frequency of 894 MHz of the receiving band in the AMPS band, the maximum gain is about −1.4 dBi, the minimum gain is about −2.3 dBi, the average gain is about −1.8 dBi, and the ripple is about 1.0 dB. Therefore, the substantially omnidirectional, good directivity characteristics are obtained.

Referring to FIG. 5, when the elevation angle is set to 0°, in the lower limit frequency of 1850 MHz of the transmitting band in the PCS band, the maximum gain is about 0.5 dBi, the minimum gain is about −0.9 dBi, the average gain is about −0.2 dBi, and the ripple is about 1.4 dB. Therefore, the substantially omnidirectional, good directivity characteristics are obtained, and the high gain is obtained. In the upper limit frequency of 1910 MHz of the transmitting band in the PCS band, the maximum gain is about 1.0 dBi, the minimum gain is about −0.5 dBi, the average gain is about 0.2 dBi, and the ripple is about 1.5 dB. Therefore, the substantially omnidirectional, good directivity characteristics are obtained, and the higher gain is obtained. In the lower limit frequency of 1930 MHz of the receiving band in the PCS band, the maximum gain is about 1.2 dBi, the minimum gain is about −0.3 dBi, the average gain is about 0.5 dBi, and the ripple is about 1.5 dB. Therefore, the substantially omnidirectional, good directivity characteristics are obtained, and the higher gain is obtained. In the upper limit frequency of 1990 MHz of the receiving band in the PCS band, the maximum gain is about 0.3 dBi, the minimum gain is about −1.0 dBi, the average gain is about −0.3 dBi, and the ripple is about 1.3 dB. Therefore, the substantially omnidirectional, good directivity characteristics are obtained, and the high gain is obtained.

FIG. 6 illustrates directivity characteristics in the horizontal plane of each frequency in the AMPS band and PCS band when the dual-band antenna 1 according to the invention has the elevation angle of 10°. Referring to FIG. 6, in the lower limit frequency of 824 MHz of the transmitting band in the AMPS band, the maximum gain is about 0.2 dBi, the minimum gain is about −0.4 dBi, the average gain is about −0.2 dBi, and the ripple is about 0.6 dB. Therefore, the substantially omnidirectional, good directivity characteristics are obtained, and the gain is improved. In the upper limit frequency of 849 MHz of the transmitting band in the AMPS band, the maximum gain is about 1.0 dBi, the minimum gain is about 0.5 dBi, the average gain is about 0.7 dBi, and the ripple is about 0.5 dB. Therefore, the substantially omnidirectional, good directivity characteristics are obtained, and the gain is further improved. In the lower limit frequency of 869 MHz of the receiving band in the AMPS band, the maximum gain is about 1.0 dBi, the minimum gain is about 0.4 dBi, the average gain is about 0.8 dBi, and the ripple is about 0.6 dB. Therefore, the substantially omnidirectional, good directivity characteristics are obtained. In the upper limit frequency of 894 MHz of the receiving band in the AMPS band, the maximum gain is about 1.0 dBi, the minimum gain is about 0.2 dBi, the average gain is 0.7 dBi, and the ripple is about 0.7 dB. Therefore, the substantially omnidirectional, good directivity characteristics are obtained.

Referring to FIG. 6, when the elevation angle is set to 10°, in the lower limit frequency of 1850 MHz of the transmitting band in the PCS band, the maximum gain is about 4.5 dBi, the minimum gain is about 3.4 dBi, the average gain is about 3.9 dBi, and the ripple is about 1.1 dB. Therefore, the substantially omnidirectional, good directivity characteristics are obtained, and the high gain is obtained. In the upper limit frequency of 1910 MHz of the transmitting band in the PCS band, the maximum gain is about 4.4 dBi, the minimum gain is about 3.4 dBi, the average gain is about 3.9 dBi, and the ripple is about 1.1 dB. Therefore, the substantially omnidirectional, good directivity characteristics are obtained, and the high gain is maintained. In the lower limit frequency of 1930 MHz of the receiving band in the PCS band, the maximum gain is about 4.6 dBi, the minimum gain is about 3.5 dBi, the average gain is about 4.1 dBi, and the ripple is about 1.1 dB. Therefore, the substantially omnidirectional, good directivity characteristics are obtained, and the higher gain is obtained. In the upper limit frequency of 1990 MHz of the receiving band in the PCS band, the maximum gain is about 3.6 dBi, the minimum gain is about 2.6 dBi, the average gain is about 3.1 dBi, and the ripple is about 1.0 dB. Therefore, the substantially omnidirectional, good directivity characteristics are obtained, and the high gain is obtained.

FIG. 7 illustrates directivity characteristics in the horizontal plane of each frequency in the AMPS band and PCS band when the dual-band antenna 1 according to the invention has the elevation angle of 20°. Referring to FIG. 7, in the lower limit frequency of 824 MHz of the transmitting band in the AMPS band, the maximum gain is about 1.8 dBi, the minimum gain is about 1.4 dBi, the average gain is about 1.7 dBi, and the ripple is about 0.4 dB. Therefore, the substantially omnidirectional, good directivity characteristics are obtained, and the high gain is obtained. In the upper limit frequency of 849 MHz of the transmitting band in the AMPS band, the maximum gain is about 2.6 dBi, the minimum gain is about 2.2 dBi, the average gain is about 2.4 dBi, and the ripple is about 0.5 dB. Therefore, the substantially omnidirectional, good directivity characteristics are obtained, and the gain is further improved. In the lower limit frequency of 869 MHz of the receiving band in the AMPS band, the maximum gain is about 3.1 dBi, the minimum gain is about 2.7 dBi, the average gain is about 2.9 dBi, and the ripple is about 0.4 dB. Therefore, the substantially omnidirectional, good directivity characteristics are obtained, and the gain is further improved. In the upper limit frequency of 894 MHz of the receiving band in the AMPS band, the maximum gain is about 3.0 dBi, the minimum gain is about 2.6 dBi, the average gain is 2.8 dBi, and the ripple is about 0.4 dB. Therefore, the substantially omnidirectional, good directivity characteristics are obtained, and the high gain is obtained.

Referring to FIG. 7, when the elevation angle is set to 20°, in the lower limit frequency of 1850 MHz of the transmitting band in the PCS band, the maximum gain is about 6.6 dBi, the minimum gain is about 5.8 dBi, the average gain is about 6.1 dBi, and the ripple is about 0.8 dB. Therefore, the substantially omnidirectional, good directivity characteristics are obtained, and the high gain is obtained. In the upper limit frequency of 1910 MHz of the transmitting band in the PCS band, the maximum gain is about 6.6 dBi, the minimum gain is about 5.7 dBi, the average gain is about 6.2 dBi, and the ripple is about 0.9 dB. Therefore, the substantially omnidirectional, good directivity characteristics are obtained, and the high gain is maintained. In the lower limit frequency of 1930 MHz of the receiving band in the PCS band, the maximum gain is about 6.7 dBi, the minimum gain is about 5.7 dBi, the average gain is about 6.3 dBi, and the ripple is about 1.0 dB. Therefore, the substantially omnidirectional, good directivity characteristics are obtained, and the higher gain is obtained. In the upper limit frequency of 1990 MHz of the receiving band in the PCS band, the maximum gain is about 5.7 dBi, the minimum gain is about 5.0 dBi, the average gain is about 5.4 dBi, and the ripple is about 0.7 dB. Therefore, the substantially omnidirectional, good directivity characteristics are obtained, and the high gain is obtained.

FIG. 8 illustrates directivity characteristics in the horizontal plane of each frequency in the AMPS band and PCS band when the dual-band antenna 1 according to the invention has the elevation angle of 30°. Referring to FIG. 8, in the lower limit frequency of 824 MHz of the transmitting band in the AMPS band, the maximum gain is about 2.9 dBi, the minimum gain is about 2.5 dBi, the average gain is about 2.7 dBi, and the ripple is about 0.3 dB. Therefore, the substantially omnidirectional, good directivity characteristics are obtained, and the high gain is obtained. In the upper limit frequency of 849 MHz of the transmitting band in the AMPS band, the maximum gain is about 3.4 dBi, the minimum gain is about 3.0 dBi, the average gain is about 3.2 dBi, and the ripple is about 0.4 dB. Therefore, the substantially omnidirectional, good directivity characteristics are obtained, and the gain is further improved. In the lower limit frequency of 869 MHz of the receiving band in the AMPS band, the maximum gain is about 4.0 dBi, the minimum gain is about 3.5 dBi, the average gain is about 3.8 dBi, and the ripple is about 0.5 dB. Therefore, the substantially omnidirectional, good directivity characteristics are obtained, and the gain is further improved. In the upper limit frequency of 894 MHz of the receiving band in the AMPS band, the maximum gain is about 3.9 dBi, the minimum gain is about 3.5 dBi, the average gain is 3.8 dBi, and the ripple is about 0.5 dB. Therefore, the substantially omnidirectional, good directivity characteristics are obtained, and the high gain is obtained.

Referring to FIG. 8, when the elevation angle is set to 30°, in the lower limit frequency of 1850 MHz of the transmitting band in the PCS band, the maximum gain is about 5.1 dBi, the minimum gain is about 3.5 dBi, the average gain is about 4.5 dBi, and the ripple is about 1.7 dB. Therefore, the substantially omnidirectional, good directivity characteristics are obtained, and the high gain is obtained. In the upper limit frequency of 1910 MHz of the transmitting band in the PCS band, the maximum gain is about 5.5 dBi, the minimum gain is about 3.9 dBi, the average gain is about 4.9 dBi, and the ripple is about 1.7 dB. Therefore, the substantially omnidirectional, good directivity characteristics are obtained, and the high gain is maintained. In the lower limit frequency of 1930 MHz of the receiving band in the PCS band, the maximum gain is about 5.7 dBi, the minimum gain is about 4.2 dBi, the average gain is about 5.1 dBi, and the ripple is about 1.5 dB. Therefore, the substantially omnidirectional, good directivity characteristics are obtained, and the higher gain is obtained. In the upper limit frequency of 1990 MHz of the receiving band in the PCS band, the maximum gain is about 4.8 dBi, the minimum gain is about 3.5 dBi, the average gain is about 4.3 dBi, and the ripple is about 1.3 dB. Therefore, the substantially omnidirectional, good directivity characteristics are obtained, and the high gain is obtained.

As described above, the dual-band antenna 1 of the invention is operated in the two different frequency bands including the AMPS band and the PCS band, and the substantially omnidirectional directivity characteristics can be obtained when the elevation angle ranges from 0° to 30°. In the two different frequency bands including the AMPS band and the PCS band of the dual-band antenna 1 according to the invention, the gain tends to be increased in the PCS band on the high frequency side. At this point, because the dipole antenna has the gain of 2.15 dBi, the gain largely exceeding the gain of the dipole antenna is obtained in the two different frequency bands depending on the elevation angle. Even if the two different frequency bands are set to GSM 900 and GSM 1800 bands, the electric characteristics similar to those described above can be obtained in the dual-band antenna 1 of the invention. Accordingly, the dual-band antenna 1 of the invention can sufficiently be operated in the two different frequency bands. When the two different frequency bands operated are changed from the 900-MHz band or 1800-MHz band to other bands, the dimensions of the first element 11 or second element 21 are changed according to the band, which allows the dual-band antenna 1 of the invention to be operated in the desired two different frequency bands. The dual-band antenna 1 according to the invention can be formed in a compact and low-profile antenna having the height of about 50 mm and the width of about 15 mm. Further, the first element 11 and the second element 21 are formed by the print pattern of the print board 10 to configure the dual-band antenna 1 of the invention, so that the simple dual-band antenna can be configured at low cost.

INDUSTRIAL APPLICABILITY

In the dual-band antenna 1 according to the invention, the power feeding line 21*a* through which the power is fed to the second element 21 may be formed into a meander shape to suppress the antenna height of the dual-band antenna 1 to a lower level. When the dual-band antenna 1 of the invention is mounted on the vehicle, the dual-band antenna 1 is fixed to an antenna base attached to the vehicle, and a radome that is of a resin cover with which the dual-band antenna 1 is covered is preferably attached to the antenna base.

In the dual-band antenna 1 of the invention, the two different frequency bands are matched with each other by the pattern shapes of the first element 11 formed in the surface of the print board 10 and the second element 21 formed in the rear surface, so that the miniaturization and cost reduction can be achieved in the dual-band antenna 1. Therefore, the dual-band antenna 1 of the invention can easily be combined with an AM/FM broadcasting receiving antenna, a GPS signal receiving antenna, a terrestrial digital broadcasting receiving antenna, a DAB (Digital Audio Broadcast) receiving antenna, and an SDARS (Satellite Digital Audio Radio) receiving antenna.

The invention claimed is:

1. A dual-band antenna comprising:

a first element that is formed into a planar shape in one of surfaces of an insulating board from a lower end of the board toward an upper portion of the board;

a second element that is formed in an upper portion of the other surface of the board so as not to overlap the first element;

a gland that is disposed at the lower end of the board;

power feeding means for feeding power to the lower end of the first element; and a throughhole that is made in an end portion of a power feeding line and connected to a middle of the first element, the power feeding line being led out from the second element formed in the other surface of the board, wherein a slit is formed in a region of the first element that overlaps the power feeding line.

2. The dual-band antenna according to claim 1, wherein a tapered portion is formed toward a lower end from at the middle of the first element.

3. The dual-band antenna according to claim 1, wherein both sides of the second element are folded downward, and the power feeding line is drawn from a substantial center of the second element.

4. The dual-band antenna according to claim 1, wherein the first element and the second element include print patterns formed on the board.

* * * * *